US009370944B2

(12) United States Patent
Barnes et al.

(10) Patent No.: US 9,370,944 B2
(45) Date of Patent: Jun. 21, 2016

(54) CALIBRATION OF A RETRO-REFLECTIVE SENSOR

(71) Applicant: HEWLETT-PACKARD DEVELOPMENT COMPANY, L.P., Houstson, TX (US)

(72) Inventors: Arthur Barnes, Vancouver, WA (US); Pierre J. Kaiser, Portland, OR (US); Alexander Toia, Vancouver, WA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 345 days.

(21) Appl. No.: 13/755,554

(22) Filed: Jan. 31, 2013

(65) Prior Publication Data

US 2014/0210899 A1 Jul. 31, 2014

(51) Int. Cl.
*B41J 29/393* (2006.01)
*B41J 11/00* (2006.01)

(52) U.S. Cl.
CPC ..... *B41J 11/0095* (2013.01)

(58) Field of Classification Search
CPC ..... B41J 2/125; B41J 29/393; B41J 11/0095; G03G 15/65
USPC ..... 347/19; 399/389
See application file for complete search history.

(56) References Cited

U.S. PATENT DOCUMENTS

| | | | | |
|---|---|---|---|---|
| 5,751,443 | A * | 5/1998 | Borton et al. | 356/446 |
| 7,874,635 | B2 | 1/2011 | Kusaka | |
| 2008/0316246 | A1 | 12/2008 | McReynolds et al. | |
| 2010/0272462 | A1 | 10/2010 | Murayama | |
| 2011/0026087 | A1 * | 2/2011 | Majewicz | 358/509 |
| 2011/0216295 | A1 | 9/2011 | Kyogoku | |
| 2012/0152696 | A1 | 6/2012 | Lorello et al. | |

OTHER PUBLICATIONS

Kuehn et al., "Active Optical Sensor for Electromagnetic Field Measurements in Time and Frequency Domains," Apr. 12-16, 2010, 2 p.

* cited by examiner

*Primary Examiner* — Julian Huffman
(74) *Attorney, Agent, or Firm* — Conley Rose

(57) ABSTRACT

A printer system includes a handling system to move print media, a print medium detection sensor to produce a response indicative of an object, and a processor coupled to the handling system and to the print medium detection sensor to perform a two-point calibration of the sensor. The first point of the two-point calibration includes a first response from the sensor, and a second point of the two-point calibration includes a second response from the sensor.

20 Claims, 8 Drawing Sheets

CALIBRATION OF A RETRO-REFLECTIVE SENSOR

BACKGROUND

Printers for transferring images to paper or other media may include sensors to detect the presence of a sheet of print media, often times being triggered by the approaching edge of the print media. The useful life of a printer may be impaired by unreliable sensors.

BRIEF DESCRIPTION OF THE DRAWINGS

For a detailed description of various examples, reference will now be made to the accompanying drawings in which.

NOTATION AND NOMENCLATURE

Figure 1:
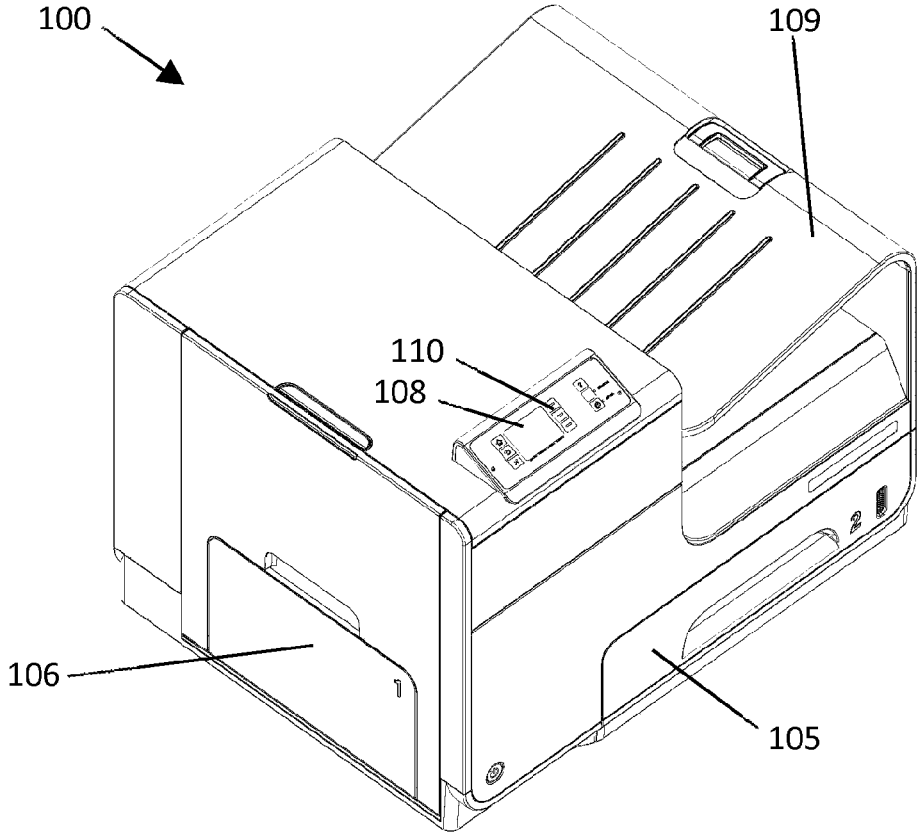
FIG. 1 shows a printing system in accordance with at least one example.

Certain terms are used throughout the following description and claims to refer to particular system components. Companies and people may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first component couples or is coupled to a second component, the connection between the components may be through a direct engagement of the two components, or through an indirect connection that is accomplished via other intermediate components, devices and/or connections. In addition, if the connection is an electrical connection, whether analog or digital, the coupling may comprise wires or a mode of wireless electromagnetic transmission, for example, radio frequency, microwave, optical, or another mode. So too, the coupling may comprise a magnetic coupling or any other mode of transfer known in the art, or the coupling may comprise a combination of any of these modes. The recitation "based on" means "based at least in part on." Therefore, if X is based on Y, X may be based on Y and any number of other factors.

The drawing figures are not necessarily to scale. Certain features and components disclosed herein may be shown exaggerated in scale or in somewhat schematic form, and some details of conventional elements may not be shown in the interest of clarity and conciseness. In some of the figures, in order to improve clarity and conciseness of the figure, one or more components or aspects of a component may be omitted or may not have reference numerals identifying the features or components that are identified elsewhere. In addition, like or identical reference numerals may be used to identify equivalent or similar elements.

References made regarding a direction, for example upward or leftward, and references made regarding a position, such as bottom, top, or side, are made for the purpose of clarification and pertain to the orientation of an object as shown. If the object were viewed from another orientation or were mounted in a different orientation, it may be appropriate to describe the direction or the position using an alternate term.

In addition, as used herein, including the claims, the terms "axial" and "axially" generally mean along or parallel to a given axis (e.g., central axis of a body or a port), while the terms "radial" and "radially" generally mean perpendicular to the axis. For instance, an axial distance refers to a distance measured along or parallel to the axis, and a radial distance means a distance measured perpendicular to the axis.

As used herein, including the claims, the term "print medium" will generally refer to a piece or a sheet of print media, but the use of the term "print medium" does not necessarily exclude multiple sheets of print media.

DETAILED DESCRIPTION

FIG. 1 shows an example of a printer system. Printer system 100 includes a print media tray 105, an externally loading print media tray 106 having a door that rotates downward, a user display 108, and an output tray 109. User display 108 may provide visual feedback and information to the user of the printer and includes user input controls 110 (e.g., buttons) that can be activated by the user to cause various actions to be performed by the printer system 100. Printer system 100 may also be called "printer" 100.

Figure 2:
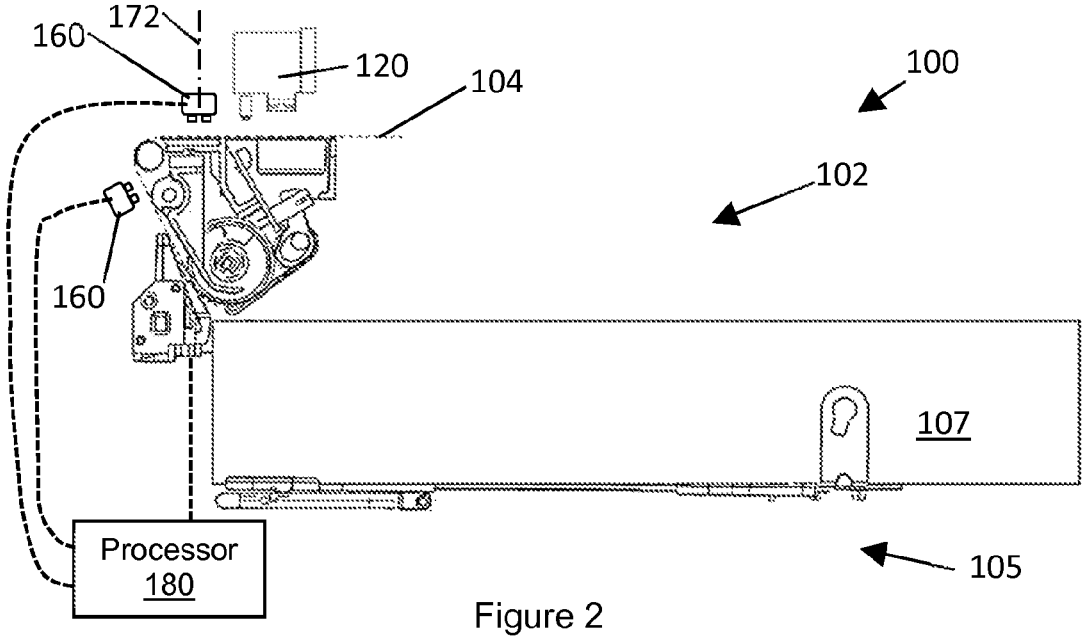
FIG. 2 shows side view including a print media handling system of the printing system of FIG. 1 in accordance with at least one example.

Referring to FIG. 2, the printer system 100 also includes a handling system 102 for print media, an image forming mechanism 120 to form an image on print media, and an object detection sensor 160 to indicate the presence of print media. Thus, for printer system 100, the object detection sensor 160 may also be called a "print medium detection sensor" 160. The sensor 160 may indicate, for example, the presence of one sheet of print media or the presence of multiple pieces or sheets of print media. In the example of FIG. 2, two print medium detection sensors 160 are shown. In various implementations, any practical number of print medium detection sensors 160 may be included.

Handling system 102 moves print media through a print media path extending from a tray 105, 106, past an image forming mechanism 120, and into an output tray 109. In one example a print medium 107 from tray 105 is moved along a print media path 104, which is shown in FIG. 2.

In various implementations, image forming mechanism 120 may be a print-head, a page-wide print array, a laser printing mechanism, or another suitable mechanism. In at least one embodiment, handling system 102 is capable of bi-directional movement of print media in at least some portion of a print media path. In at least one embodiment, printer 100 is capable of duplex printing, i.e., printing on two sides of the same piece of print media. When forming an image, printer 100 may process data for the image from memory storage located within printer 100, from an external memory storage device, from an externally coupled computer, or from another suitable source of data (not shown). The image may include text and graphics.

Figure 3:
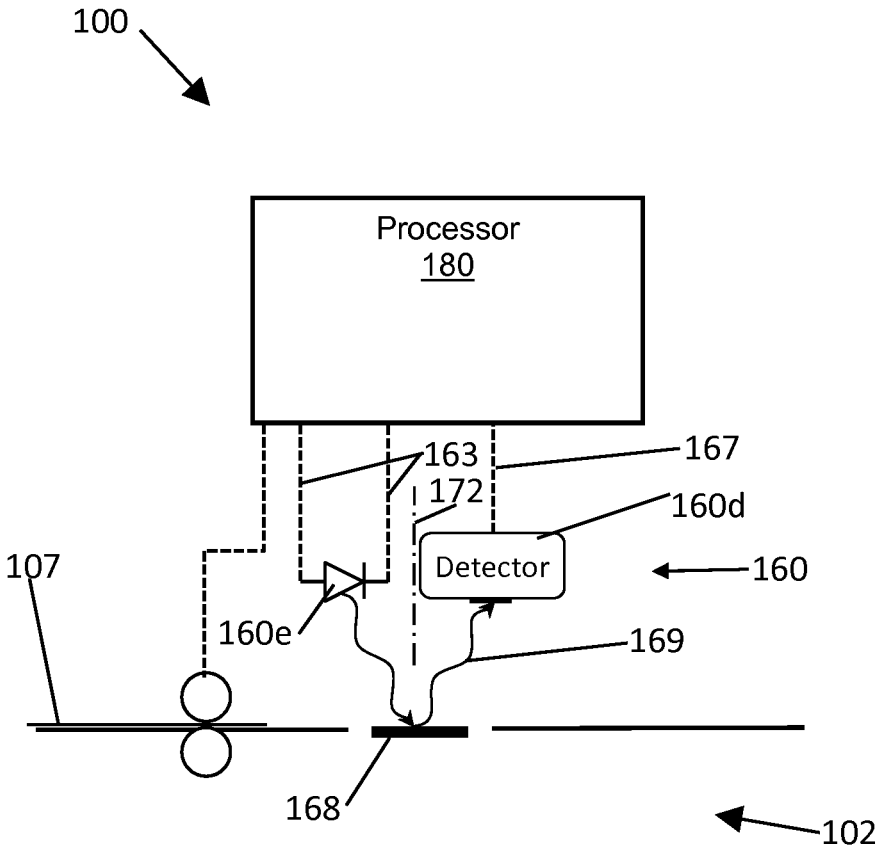
FIG. 3 shows a schematic including a processor and an object detection system of the printing system of FIG. 1 in accordance with at least one example.

Referring to the schematic view of in FIG. 3, printer 100 further includes a mirror adjacent and facing sensor 160 and a processor 180 coupled to the handling system 102 and to the print medium detection sensor 160. Processor 180 controls handling system 102 and sensor 160 and performs any of multiple types of calibrations of the sensor 160 at selected or prescribed times.

When the interaction of a single sensor 160 and processor 180 is discussed, it is understood that the concept may apply to any of the multiple sensors 160 that may be in printer 100. Similarly, when multiple sensors 160 are discussed, it is understood that in some instances or in some implementations a single sensor 160 may be involved.

The processor 180 may initiate a calibration of sensor 160 based on criteria pertaining to any of several events or operational parameters. These operational parameters may include, for example, the first start-up of the printer 100 (which in at least some instances occurs at the factory), the count of total pages printed (i.e., total page count), time elapsed since first start-up or since an earlier calibration, the level of a response from the sensor 160, or any other suitable parameter or event that may be monitored by processor 180. The processor 180 may initiate a calibration of sensor 160 based on receipt of an external command signal such as may come from an external computer or from user input controls 110 in some implementations. Printer system 100 may include various sensors, clocks, counters, non-transitory computer-readable storage devices, an analog-to-digital converter, or other components appropriate for aiding processor 180 in monitoring and controlling as least some aspects of the performance of printer 100. In some implementations, sensor 160 aids in generating the total page count. Various types of calibrations or replications of a single type of calibration may be performed separately or sequentially by processor 180. In general, the multiple calibrations may be performed in any order with each calibration having its own prescribed criteria or frequency.

In various implementations, processor 180 includes a non-transitory computer-readable storage device having executable software instructions to perform calibrations of sensors 160. The software instructions may include separate modules for performing multiple types of calibrations, for example, a module for a two-point calibration and a module for a one-point calibration of sensors 160. In some implementations, the two-point calibration may occur at the first start-up (energizing) of the printer 100, and the one-point calibration may occur periodically later in the printer's life, for example after each event in which the total page count is a multiple of a prescribed value. Examples of the two-point calibration and the one-point calibration will be explained subsequently.

Continuing to reference the schematic of FIG. 3, print medium detection sensor 160 includes an optical emitter (e.g., a light emitting diode (LED)) 160*e* and an optical detector (e.g., a photo detector or phototransistor) 160*d*. Emitter 160*e* and detector 160*d* are positioned side-by-side, facing a reference surface, the reference surface having a higher reflectivity than various types of print media, including print medium 107. A central axis 172 passes between the emitter 160*e* and the detector 160*d*. As examples, in various instances, the print medium 107 may have a shiny, dull, or matte finish and may be white, bright white, colored, transparent, or translucent. The print media viewed by the sensor 160 may include ink or toner as in the case of duplex printing, for example. In the implementation of FIG. 3, the reference surface is a mirror 168 and is positioned along print media path 104 such that print medium 107 can slide adjacent or between mirror 168 and emitter-detector pair 160*e*, 160*d*. The print media path 104 and the print medium 107 can be positioned perpendicular to or at another angle relative to the sensor 160. Emitter 160*e* couples to processor 180 by an electrical coupling 163, and detector 160*d* couples to processor 180 by electrical connection 167. In the implementation of FIG. 3, electrical connections 163, 167 are wires or cables of wires.

Light from emitter 160*e* may follow a transmission path 169 to detector 160*d*. In various instances, the mirror 168 acts as a reflective target, participating in transmission path 169. In various other instances, handing system 102 moves the print medium 107 over the surface of mirror 168, and so print medium 107 may act as the reflective target in the transmission path 169. A portion of the light emitted by emitter 160*e* may be reflected by the target and arrive at detector 160*d*.

The emitter-detector pair 160*e*, 160*d* is configured to operate using light having a suitable wavelength. In some instances, the suitable wavelength may be one of the following: infrared, red, white, or blue, for example. The light may include multiple wavelengths, e.g., white or a range of red wavelengths. Light of a suitable wavelength is light that can be reflected from both mirror 168 and from a variety of print media, such as print medium 107.

In various implementations, the response signal from the detector 160*e* is a variable, analog signal, and this signal is inverted and is converted to a digital signal or value by processor 180. This inverted, digitized value may be described as the "response of sensor 160" or the "sensor response." In some implementations, circuitry within sensor 160 may aid with the inversion or digitizing of the analog detector response signal. In various implementations, the response signal from the detector 160*e* is not inverted when producing the sensor response, and in such cases the logic for interpreting the sensor response, which will be explained below, is adjusted accordingly.

Once inverted and digitized, the sensor response may span integer values ranging from a minimum to a maximum. For example, the minimum value is zero and the maximum value is 511 in the implementation discussed herein. The range of digital values may differ in other implementations, depending on, for example, the resolution of the analog-to-digital converter implemented by processor 180. Due to inverting the signal from detector 160*e*, an indirect relationship exists between the intensity of light received by detector 160*d* and the sensor response generated by processor 180. Consequently, the sensor response is anticipated to decrease, when, for example, the average power supplied to emitter 160*e* is increased. Also due to inverting the signal, the sensor response that results from the presence of mirror 168 is anticipated to be less than the sensor digitized response that results from the presence print medium 107, even though mirror 168 has a higher reflectivity.

The response of sensor 160 may be used by processor 180 to control the print media handling system 102, to control ink transfer mechanism 120, to send an error signal to user display 108 or to an externally coupled computer, or to perform another function for printer 100.

During operation of printer system 100, processor 180 provides a variable level of electrical power to emitter 160*e* via electrical connection 163. Processor may adjust the level of power by varying a voltage or by varying a current supplied through electrical connection 163. A selected level of average power may be maintained until a system event occurs, such as a calibration of sensor 160. After the event, processor 180 may adjust the level of power for emitter 160*e*. Processor 180 may also provide power to detector 160*d*., and that power may remain relatively constant.

In various implementations in accordance with the example of FIG. 3, processor 180 varies the level of electrical power supplied to the emitter 160*e* by pulse-width modulation. In other implementations, processor 180 may vary the power supplied to the emitter by another suitable means. Using pulse-width modulation, a relatively constant source voltage, for example, may be cycled on and off periodically to reduce an average voltage and average power supplied to emitter 160*e*, which may be called the emitter voltage and emitter power level, respectively. The source voltage may have a constant voltage of 3.3 VDC, for example. The percent of "on" time is called the duty cycle of the pulse-width modulation. A lower average voltage and power are supplied to emitter 160*e* by reducing the duty cycle, and a higher average voltage and power are supplied to emitter 160*e* by increasing the duty cycle. The duty cycle can range from a minimum, e.g., 0%, to a maximum, e.g., 100%. A duty cycle of 100% may result in an emitter voltage roughly equal to the source voltage. A duty cycle of 0% may result in the emitter 160*e* being off or inactive. Portions of the full range of duty cycle, which is 0 to 100%, may not result in sensor 160 yielding useful sensor responses.

Processor 180 stores a duty cycle value for each sensor 160 or, more precisely, for each emitter 160*e*. Processor 180 may store default values for duty cycle, values set at the factory where printer system 100 is made. Processor 180 can vary the duty cycle individually for each sensor 160. For practical purposes, processor 180 may use a discrete, incremental value when increasing or decreasing a duty cycle. The duty cycle increment may be, for example, 1% of the maximum value of duty cycle. In some instances, a change in the duty cycle may be accomplished by using repeated applications of the duty cycle increment or by using a multiple value of the duty cycle increment, for example two multiplied by the duty cycle increment. In various implementations, the duty cycle increment may be changed manually or may be changed by processor 180 and may be based on process conditions.

During operation of print medium detection sensor 160, emitter 160*e* may emit an optical beam, i.e., light, having an intensity that is a function of the average power supplied to the emitter 160*e*. For example, the light intensity produced may be directly proportional to the average magnitude of supplied power so that as the average magnitude of the supplied power increases, the light intensity from emitter 160*e* increases.

In general, the magnitude of the sensor response may vary based on any of several factors related to sensor 160, including, for example, a power level associated with the emitter, the operational behavior of the emitter 160*e*, the reflectivity, angle, or location of the selected reflective target in transmission path 169, the clarity, opacity, or length of the transmission path 169, the operational behavior of the detector 160*d*, and dust accumulation on emitter 160*e* or detector 160*d*. These factors are therefore characteristics associated the sensor. The magnitude of the sensor response is itself a characteristics associated the sensor. At least some of the characteristics associated the sensor may be adjusted by processor 180 during operation or during a calibration. For example, processor 180 may adjust a power level associated with the emitter 160*e* by various means, including, for example, by adjusting the duty cycle of a pulse-width modulated power source. In addition to the power supplied to the emitter 160*e*, various power levels associated with the emitter 160*e* include the intensity of the light produced by the emitter 160*e*, the intensity of light incident on mirror 168 or print medium 107, and the intensity of light incident on detector 160*d*.

During operation of printer system 100, processor 180 periodically receives and processes sensor responses from the sensor 160. Based on the characteristics of the sensor 160 and possibly other factors or characteristics of printer system 100, a first threshold value, Threshold 1, may be defined to be to a digital value that differentiates a sensor response resulting from mirror 168 versus a sensor response resulting from print media 107. Processor 180 compares the sensor responses against the first threshold value to detect the presence of print media in the handling system, e.g., to determine whether or not print medium 107 reaches, dwells, or leaves in transmission path 169. Table 1 lists Threshold 1 among various operational parameters associated with possible responses from the object detection sensors 160. Table 1 also includes example values for the parameters. In various implementations, the threshold values, such as Threshold 1, remain constant. In various other implementations, processor 180 may vary a threshold value, such as Threshold 1, based on the results of any of the calibrations described herein.

Referring to Table 1, When the sensor response falls within a range of values from zero to Threshold 1, the sensor 160 is said to be in a "State 0" (State Zero). State 0 generally corresponds to times when the reference surface, which in this implementation is mirror 168, is in transmission path 169 and is seen by sensor 160. When the sensor response falls within a range of values spanning from Threshold 1 to a maximum response (Table 1), the sensor 160 is said to be in a "State 1" (State One). State 1 generally corresponds to times when print media is in transmission path 169 and is seen by sensor 160. A determination of State 0 or State 1 is made by Processor 180. In some instances, the state of sensor 160 will be evaluated based on a single sensor response while in other instances the state of sensor 160 will be evaluated based on multiple sensor responses. Errors or inaccuracies in processor 180, sensor 160, or some other portion of printer 100, may cause the state of sensor 160 to be incorrectly determined by processor 180 in some instances. Performing a calibration may reduce the potential for an incorrect determination of the state of sensor 160.

TABLE 1

Operational Parameters Associated with Responses from the Object Detection Sensors

| Parameter | General Description | Example Digital Values |
|---|---|---|
| range of values | range of sensor response values at least in part based on the resolution of analog-to-digital converter | 0 (zero) to 511 |
| maximum value | maximum sensor response value at least in part based on the resolution of analog-to-digital converter | 511 |
| Threshold 1 | A value generally differentiating a sensor response that results from the reference surface (e.g., mirror 168) versus a sensor response that results from print media | 423 |
| State 0 | Condition corresponding to a range of sensor response values generally attributed to the reference surface | 0 to 423 |
| State 1 | Condition corresponding to a range of sensor response values generally attributed to print media | 424 to 511 |
| Threshold 2 | A value marking the lower boundary of a target range for response values resulting from print media | 462 |
| Threshold 3 | A target range for the response values | 380 |

TABLE 1-continued

| Operational Parameters Associated with Responses from the Object Detection Sensors | | |
|---|---|---|
| Parameter | General Description | Example Digital Values |
| | resulting from the reference surface | |
| Threshold 4 | A value to be compared against an operational parameter to determine when to start a calibration | 10,000 |
| Threshold 5 | A value marking the upper boundary of a target range for the response values resulting from the reference surface | 415 |
| Threshold 6 | A value marking the upper boundary of a target range for the response values resulting from the reference surface | 360 |
| Margin 1 | A value used in some comparisons to determine whether one parameter is close in value to another parameter | 10 |

In at least some instances, improved performance of print medium detection sensor 160 and printer system 100 may be achieved by calibrating the sensor response as a function of the emitter power level. A calibration may include sensor responses from various reflective targets, e.g., mirror 168 or print medium 107. Improved performance may result in greater accuracy or more consistent detection of the presence of print medium 107 in transmission path 169. Improved performance may result in an improved distinguishment between a sensor response produced due to the presence of print medium 107 and a sensor response produced due to the presence of mirror 168. Calibrations of printer system 100 may be performed at a variety of locations, such as a factory or in an end-user environment, for example. The improvement may include a factory rejecting or repairing printer systems 100 having a faulty sensor 160. The result may be a more robust printer being shipped from a factory. The result may include an improved performance or increased life span in an end-user environment. Other performance improvements may result from calibrating sensor 160.

During a calibration of print medium detection sensor 160, a reflective target is selected, an emitter power level is set and applied to emitter 160*e*, and the response signal from detector 160*d* is observed and converted to an inverted, digitized sensor response. The detector response signal or the sensor response is evaluated, recorded, or stored by processor 180. The combined information including the emitter power level (e.g., the magnitude of the duty cycle), the sensor response, and the type of reflective target may be called a "calibration point," a "data point," or a "point." The information about the type of reflective target may be assumed or inferred in some instances when obtaining a calibration point. In general, a calibration point may include planned operation conditions and predicted results or may include actual operation conditions and actual results.

During a calibration, the response from sensor 160 may be evaluated by processor 180 to determine an appropriate course of action. Processor 180 may perform one of various actions in conjunction with a calibration, examples of which are given here. The action may involve registering a status message, such as an error message, for the sensor 160. The action may involve recording a calibration offset or a calibration factor that may be used to modify future data from the sensor. The action may involve adjusting a variety of other characteristics associated the sensor, as was explained previously.

Figure 4:
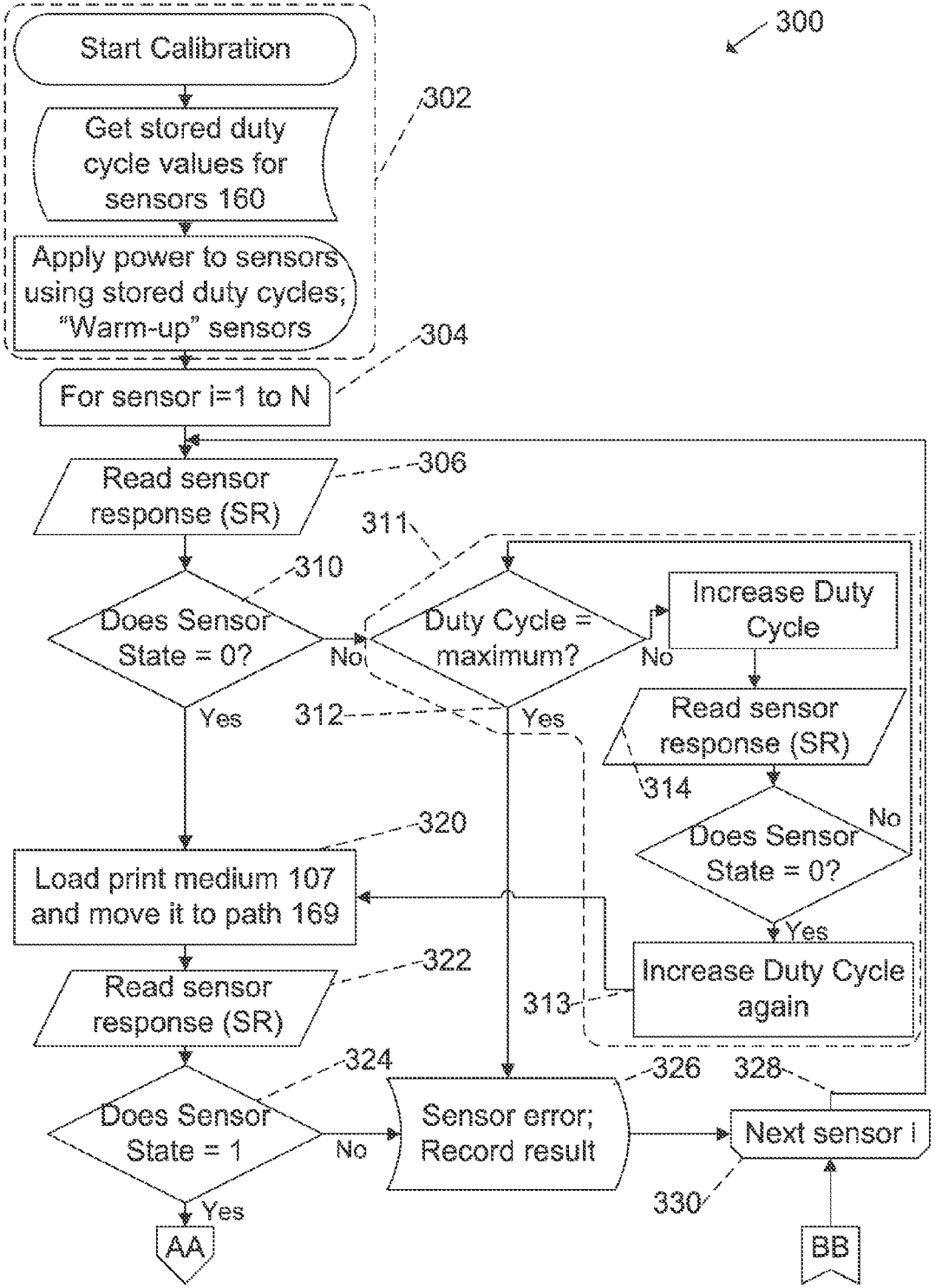
FIG. 4 shows a flow chart for a multi-point calibration method that is appropriate for the printing system of FIG. 1 in accordance with at least one example.
Figure 5:
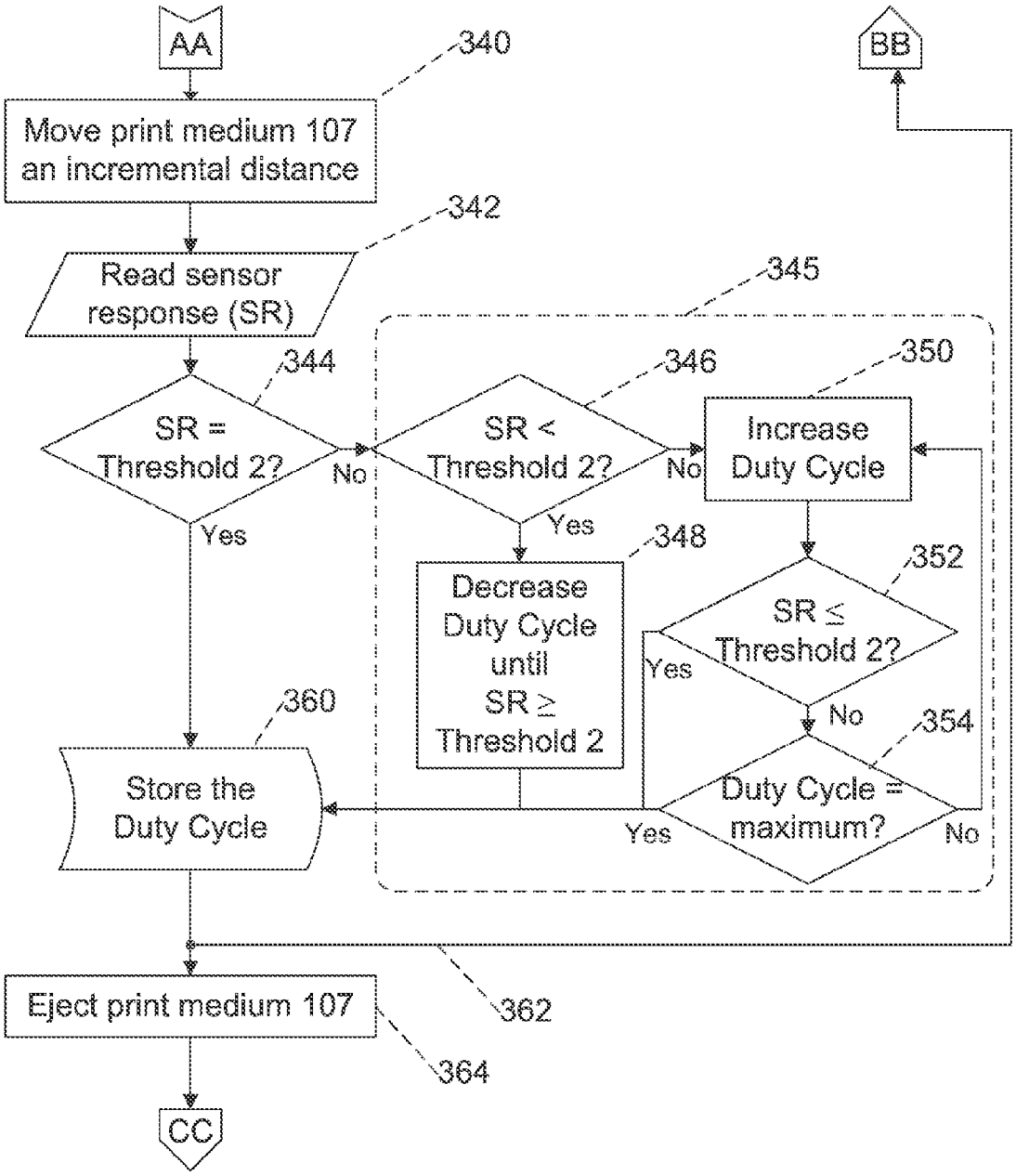
FIG. 5 shows a continuation of the flow chart of FIG. 4 in accordance with at least one example.
Figure 6:
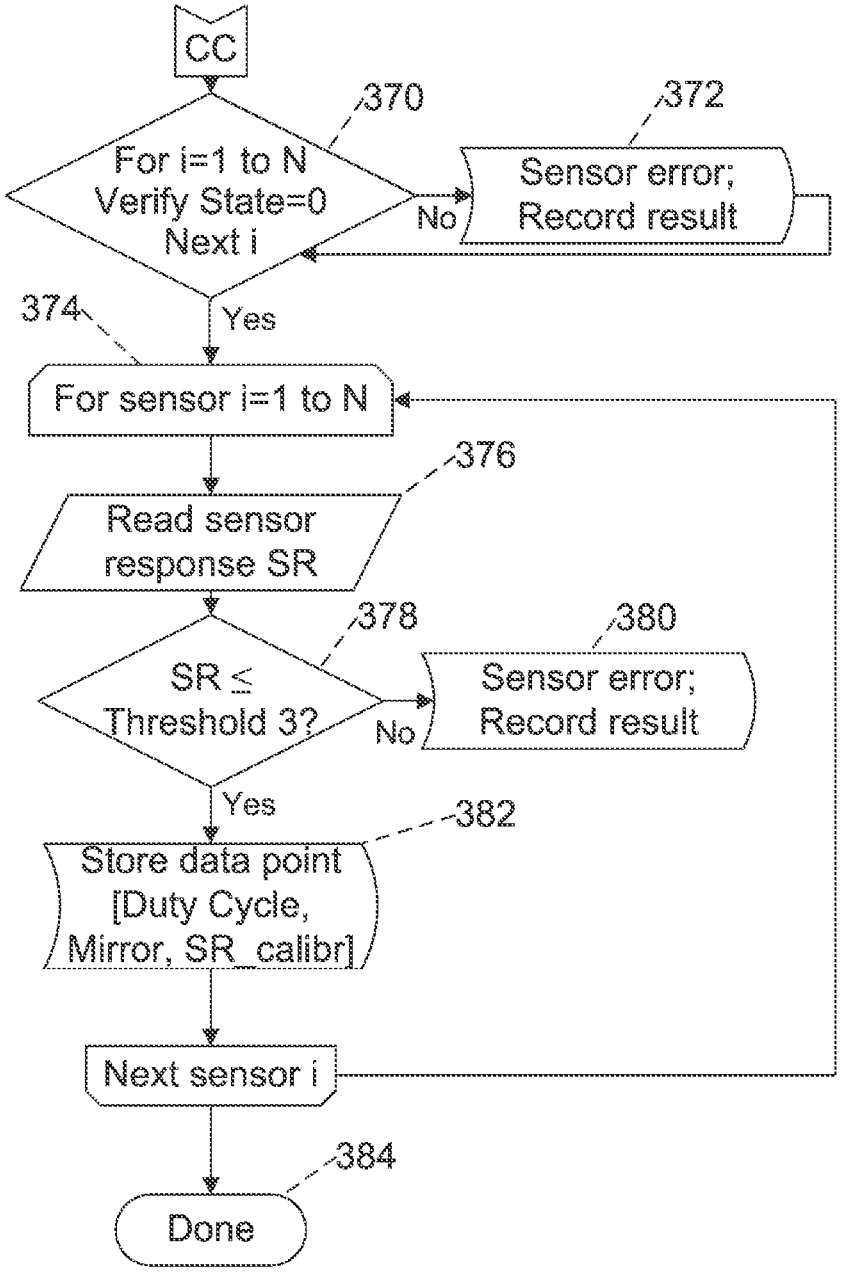
FIG. 6 shows a continuation of the flow chart of FIG. 5 in accordance with at least one example.

A process flow chart spanning FIGS. 4, 5, and 6 outlines a first type of calibration, a method 300, involving multiple calibration points for each sensor 160 that is selected for calibration. Referring first to FIG. 4, method 300 initiates in block 302. Processor 180 may initiate method 300 based on the status of any of various printer operational parameters or based on receipt of an external command signal. With printer system 100 active, processor 180 reads the duty cycle values stored for the various sensors 160, applies pulse-width modulated power to the emitters 160*e* at the corresponding duty cycle, and allows the sensors to "warm-up" or stabilize for a prescribed period of time at their respective power levels, for example 10 milliseconds. As stated previously, in various other implementations, processor 180 may vary the power supplied to the emitters 160*e* by another suitable means. Processor 180 also may provide a relatively constant power level to detectors 160*d*. Block 304 initiates a logic loop to be applied to each sensor 160. In block 304, individual sensors 160 are accounted or selected using a variable "i" that increments from one to the total number of sensors, N that are selected for calibration. N represents an integer value equal to or greater than 1. In the example described herein, the first sensor 160 selected in the sequence (i.e., when i=1) is the sensor 160 most proximal the paper tray 105, 107. Print media 107 reaches this first sensor 160 prior to reaching the other sensors 160 while travelling along print media path 104. At block 306 a first calibration point is obtained by processor 180 for the selected sensor 160. This first calibration point includes the magnitude of the duty cycle, information about the type of reflective target, in transmission path 169, which in this is mirror 168, and the magnitude of the sensor response that results from the presence of mirror 168. In at least some instances, the presence of mirror 168 in transmission path 169 is assumed prior to step 306, as may be the case, for example, in a controlled, factory environment.

In block 310, the sensor response from block 306 is evaluated against criteria corresponding to mirror surface 168. In particular, processor determines whether or not the sensor response indicates a State 0, which corresponds to a sensor response being less than or equal to Threshold 1. If the result is "yes," the sensor 160 and processor 180 detect mirror surface 168. If the result of block 310 is "no." then in block 311 further evaluation is performed, and adjustments to the duty cycle are made to establish a State 0 condition for the sensor, as is appropriate for the current reflective target, mirror 168. Block 311 includes obtaining a sensor response at block 314 after each of possibly multiple increases to the duty cycle. If block 311 is unsuccessful in achieving State 0, node 312 directs processor 180 to record an error for the sensor at block 326, indicating that sensor 160 appears to be faulty. From block 326, method 300 proceeds to the next sensor 160 in the sequence "i=1 to N" via block 330 and process pathway 328. Otherwise, if block 311 reaches a successful completion, node 313 directs the processor to block 320 at which point print medium 107 is fed through print media path 104 until reaching the transmission path 169 of the selected sensor 160. In block 320, print medium 107 may be picked from one of the media trays 105, 106 the first time that processor 160 reaches block 320 during method 300. The same print medium 107 may be advanced to other sensors 160 during subsequent iterations of the loop that starts at block 304. In other instances, a different a sheet of print media may be picked from tray 105, 107 for each sensor 160.

At block 322, processor 180 obtains a second calibration point. Like the first data point, this second calibration point includes the magnitude of the duty cycle, the type of reflective target, which in this instance is the print medium 107 and possibly its leading edge, and the magnitude of the sensor response that results from the presence of print media 107. At block 324, processor 180 evaluates the second data point and may detect and recognized the print medium 107. If so, a sensor State 1 is achieved, which corresponds to the value of sensor response being greater than Threshold 1, the movement of medium 107 is halted, and method 300 proceeds to continuation block AA leading to the flow chart on FIG. 5.

However, if State 1 is not achieved for the selected sensor 160, meaning the edge of medium 107 is not detected and recognized by processor 180 and that sensor 160, the operation of method 300 transfers from block 324 to block 326 on FIG. 4. Block 326 directs processor 180 to record an error for the sensor 160. From block 326, method 300 proceeds to evaluate the next sensor 160 via block 330 and process pathway 328.

In at least some instances, processor 180 may observe a timer before recording an error in block 326. The timer may indicate that the currently selected sensor does not transition from State 0 to State 1 in a prescribed period of time and may cause the calibration to proceed to block 330 to select and evaluate the next sensor. In various implementations, processor may repeatedly scan all sensors 160 even while processing the loop that starts at block 304 for the one selected sensor 160. If the currently selected sensor does not transition from State 0 to State 1 while print media 107 is fed according to block 320, media 107 may reach another sensor more distal along print media path 104, and that sensor may transition from State 0 to State 1 out-of-sequence. Processor 180 may use this event to precipitate recording an error at block 326 for the currently selected sensor.

For any sensor that achieves a positive result at block 324, i.e., State 1 is achieved due to print media 107, the method 300 proceeds to continuation block AA on FIG. 5, and processor 180 continues the calibration of the same selected sensor 160. Referring now to FIG. 5, block 340 directs handing system 102 to move print medium 107 an incremental distance along print media path 104. For example, the media 107 may be moved by a distance of 0.5 inch beyond the location achieved in block 320 (FIG. 4). At block 342, processor 180 obtains a third calibration point from the sensor. As this third calibration point includes a magnitude of a sensor response that results from the presence of print media 107. During the execution of block 342, the sensor 160 potentially has a full view of print medium 107 in transmission path 169, avoiding edge effects that might include reflections from the mirror 168.

In test block 344, the sensor response from block 342 is evaluated against criteria corresponding to print media. Block 344 tests whether or not the sensor response equals a Threshold 2. Threshold 2, as listed in Table 1, marks the lower boundary of a target range for response values resulting from print media. The value of Threshold 2 is greater than Threshold 1. If the result of block 342 is "yes," then, as specified in block 360, the duty cycle of the sensor's emitter 160*e* is accepted and stored by processor 180. If the result of block 342 is "no," the duty cycle of the emitter 160*e* is adjusted in block 345.

Continuing to reference FIG. 5, adjustment block 345 includes multiple steps for selectively decreasing or increasing the sensor 160 duty cycle to achieve a sensor response equal to or nearly equal to Threshold 2 while print medium 107 is in transmission path 169 of the sensor 160. Following a "no" response from test block 344, the calibration process proceeds to test block 346. If the sensor response previously obtained in block 342 is less than Threshold 2, the sensor response is judged to be too low, and the calibration process transfers to block 348. In block 348 the duty cycle of the sensor 160 is gradually decreased until the sensor 160 produces a response equal to Threshold 2 or, possibly, greater than Threshold 2.

If however, test block 346 determines that the sensor response previously obtained in block 342 is greater less than Threshold 2, the sensor response is judged to be too high, and block 346 transfers the calibration process to blocks 350, 352, 354 as shown in FIG. 5 in order to increase the duty cycle until the sensor 160 produces a response equal to Threshold 2 or, possibly, less than Threshold 2. In blocks 344, 345, comparing sensor response against Threshold 2 rather than the lesser Threshold 1 provides a margin of confidence so other types of print media have a greater likelihood for also producing a State 1 condition during possible operation after the calibration is complete.

Upon exiting adjustment block 345, the process executes block 360, storing the adjusted duty cycle as explained previously. After the duty cycle for the current sensor 160 is stored as instructed in block 360, the calibration process proceeds along process pathway 362 to continuation blocks BB, leading to block 330 and process pathway 328 on FIG. 4 to begin calibrating the next sensor 160. After all N sensors have been calibrated, block 364 on FIG. 5 instructs processor 180 and handling system 102 to eject print medium 107. In at least some instances, the result of block 364 is that mirrors 168 are in transmission paths 169 for the each of the respective sensors 160. The process proceeds to continuation block CC leading to FIG. 6.

Referring now to FIG. 6, in block 370, a sensor response from each sensor 160 is obtained and evaluated to determine whether or not each sensor indicates State 0, corresponding to the respective mirrors 168 being detected in transmission paths 169. At block 372 an error result is recorded for any sensor 160 that does not register a State 0 condition. Thus, in at least some implementations, another calibration point is obtained in block 370 for each sensor 160.

Block 374 initiates a loop to test the response from each sensor 160 against a more stringent criterion than the test for State 0 in Block 370. At block 376 a fourth calibration point is obtained by processor 180. The calibration point includes a sensor reading resulting from the presence of mirror surface 168. At test block 378, the sensor response from block 376 is evaluated against Threshold 3. Threshold 3 marks the upper boundary of a target range for the response values resulting from mirror 168. Table 1 provides an example value for Threshold 3. Block 376 tests for the possibility that the sensor response is less than or equal to Threshold 3. The value of Threshold 3 is less than Threshold 1, making the test of block 378 more stringent evaluation of the sensor response to mirror 168 than is the State 1 test applied in block 370. If the result of test block 376 is negative, an error result is recorded for the sensor 160 at block 380. If the result of test block 376 is positive, block 382 instructs processor 180 to store the fourth calibration point of the sensor 160 for use during future operations of printer system 100. The duty cycle of the fourth calibration point may replace the previous value that was utilized, for example, in block 302. The sensor response of the fourth calibration point is designated as "SR_calibr" in block 382. After the loop initiated by block 374 is completed for the quantity of N sensors 160, calibration method 300 terminates at block 384.

Thus, a calibration data point may be stored for each sensor 160 as specified in block 382. In each data point, the sensor response value SR_calibr indicates what sensor response was produced during calibration when viewing mirror 168 and when powered at a particular sensor's now-established setting for emitter power level, i.e., duty cycle. The sensor response value SR_calibr may be used as a reference value for other operations of printer system, including other calibrations.

In some implementations of method 300, if an error is registered for any sensor 160, the duty cycle utilized in block 302 may be retained for that sensor 160. If calibration method 300 terminates prematurely, the duty cycle utilized in block 302 may be retained for any or all sensors 160.

Any of the sensor error results from method 300 may be used by processor 180 to influence how future data from the sensor may be handled or interpreted during or after the calibration. Any of the sensor error results may be used to generate a failure report for a particular sensor 160 or for printer system 100.

In some instances, the calibration method 300 is performed in a controlled, factory environment when printer system 100 is given power for the first time after it is assembled or partially assembled. In other instances, method 300 may be performed during another portion of the life of printer system 100.

As a summary of calibration method 300 of FIGS. 4, 5, and 6, processor 180 obtains and uses the sensor responses of the first and third calibration points at blocks 306 and 344, respectively, to adjust an operational parameter influencing the performance of the sensor 160, namely its duty cycle. The duty cycle effects at least the variable power level associated with the respective emitter 160*e*. As a result, processor 180 adjusts the magnitude of the sensor's output signal, i.e., the intensity of light from emitter 160*e*. Thus, in one sense, method 300 may be called a two-point calibration. The first calibration points results from the presence of mirror 168. The third calibration results from the presence of print media 107.

Additionally in method 300, processor 180 obtains and uses the sensor responses of the second and fourth calibration points at blocks 322 and 376, respectively, to record a sensor error, which causes an adjustment to the manner in which printer system 100 handles or interprets sensor responses. Thus, more broadly, at least in some instances, method 300 may be called a four-point calibration.

As a further summary of method 300, the first and fourth calibration points at blocks 306 and 376, respectively, result from the presence of mirror 168. The second and third calibration points at blocks 322 and 344, respectively, result from the presence of print media 107.

Depending on the selective execution of blocks 311 and 345 in method 300, processor 180 may obtain and utilize other sensor readings, corresponding to calibration points, for various sensors 160 in addition to the four that have been numbered. In this manner, processor 180 may obtain a differing number of calibration points for the various sensors 160. Any of the sensor responses of method 300 may be used selectively by processor 180 to adjust a characteristic associated the sensor.

In the claims, the numbering of sensor responses may or may not correspond to the numbers assigned to the calibration points and corresponding sensor responses in various portions of this detailed description.

Figure 7:
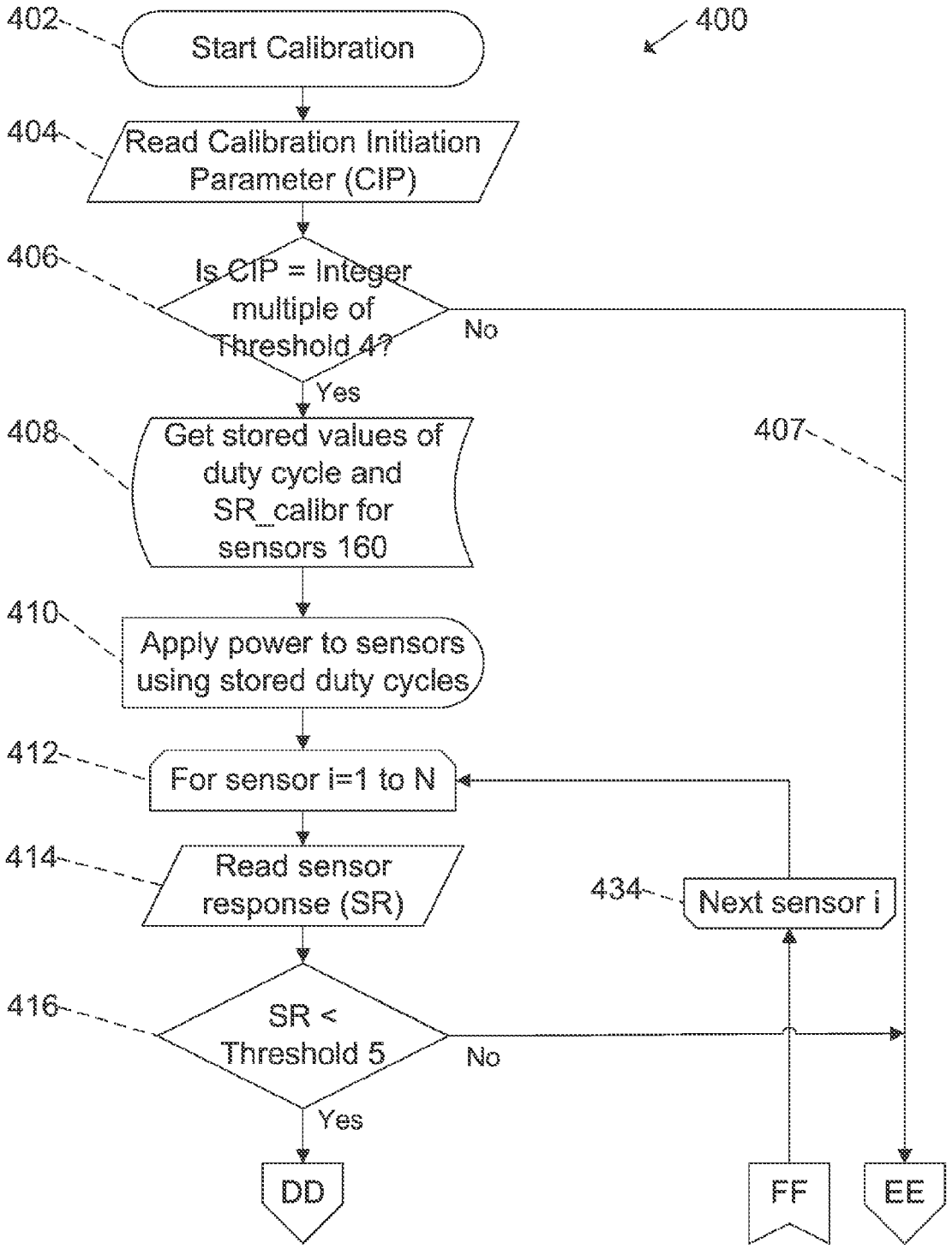
FIG. 7 shows a flow chart for a second calibration method that is appropriate for the printing system of FIG. 1 in accordance with at least one example.
Figure 8:
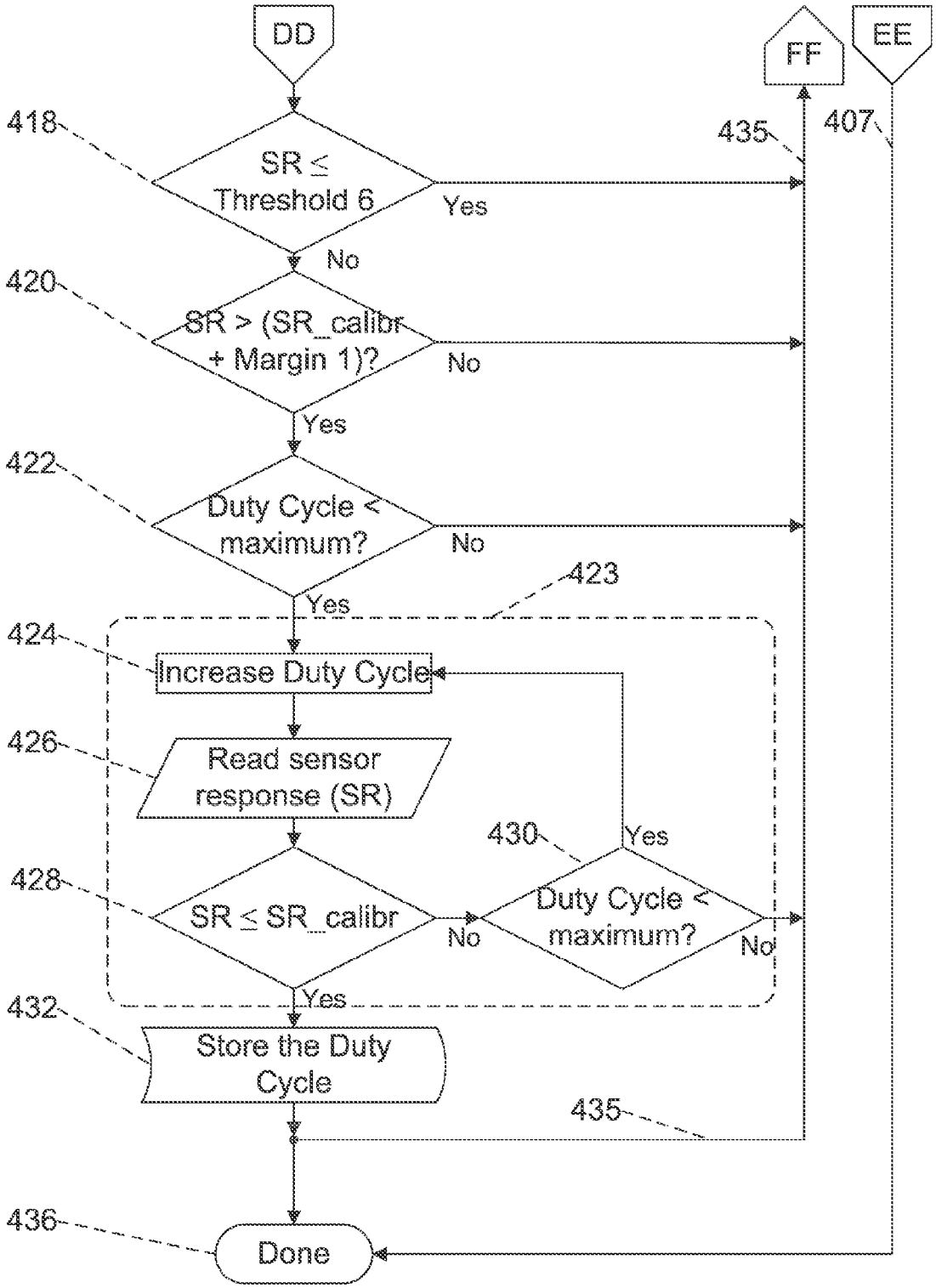
FIG. 8 shows a continuation of the flow chart of FIG. 7 in accordance with at least one example.

A process flow chart spanning FIGS. 7 and 8 outlines a second type of calibration, a method 400, involving at least one calibration point for each sensor 160 that is selected for calibration. Referring first to FIG. 7, method 400 initiates in block 402. With printer system 100 active, at block 404 the processor 180 reads a selected or prescribed calibration initiation parameter (CIP), which may be any of the operational parameters of printer system 100 or an external command signal. At test block 406 the CIP is compared against a forth threshold value (Threshold 4) to determine whether or not to initiate the calibration. Table 1 provides an example value for Threshold 4. In the example of FIG. 7 and Table 1, the selected calibration initiation parameter is the total page count. A variety of comparisons could be made in block 406. In the example of FIG. 7, block 406 evaluated whether or not the total page count has reached an integer multiple of Threshold 4. Thus, calibration of method 400 may be executed periodically during the life of printer system 100. In various other implementations, multiple criteria are applied within block 406 to determine whether or not to initiate the calibration. If the result of block 406 is "no," then the calibration steps of method 400 are by-passed and method 400 follows process pathway 407 to continuation block EE, leading to FIG. 4, and method 400 terminates at block 436.

If the result of test block 406 is "yes," the calibration proceeds. At block 408, processor 180 retrieves stored values of duty cycle and the reference value of sensor response, SR_calibr, for the sensors 160. The values retrieved in block 408 may be, for example, the calibration data point of block 382 in FIG. 6, the values pertaining to a time when the mirrors 168 were in the transmission paths 169 of the sensors 160. Processor applies power to sensors 160 using the stored duty cycles that were retrieved. Block 412 initiates a logic loop to be applied to each sensor 160. The loop continues to a block 434 on FIG. 8. This loop may also be called loop 412-434. In block 304, individual sensors 160 are accounted or selected using a variable "i" that increments from one to the total number of sensors, N that are selected for calibration. N represents an integer value equal to or greater than 1.

At block 414 a calibration point is obtained by processor 180 for the selected sensor 160. This first calibration point includes the magnitude of the duty cycle and the magnitude of the sensor response. The type of reflective target will be evaluated at a later block in method 300. In test block 416, the sensor response from block 414 is evaluated against a Threshold 5 value, which is less than Threshold 1, as shown in the example given in Table 1. If the sensor response is less than Threshold 5, it is probable that sensor 160 views mirror 168 in transmission path 169, confirming the reflective target for the calibration point of block 414. If instead the result of block 416 is "no," it is possible that a print medium is in transmission path 169. Consequently, the calibration should not continue, and so method 400 terminates at block 436.

After obtaining a positive result from test block 416, meaning the response from the selected sensor 160 is less than Threshold 5, method 400 proceeds to continuation blocks DD leading to FIG. 8. Test block 418 causes the sensor response from block 414 to be evaluated against a Threshold 6 value, which is less than Threshold 5. In the example shown in Table 1, Threshold 6 is also less that Threshold 3. If the sensor response is less than or equal to Threshold 6, the sensor 160 produces a response in the presence of mirror 168 that is sufficiently distinguished from (i.e., sufficiently less than) response values anticipated for print media. After this positive result from text block 418, the calibration proceeds to select and evaluate the next sensor 160 following process pathway 435 to continuation blocks EE and to iteration blocks 434, 412 on FIG. 7.

If instead sensor response is greater than Threshold 6, i.e., block 418 produces a negative result, the calibration continues to test block 420. The criteria in block 420 evaluates whether or not the sensor response of block 414 is greater than reference value of sensor response, SR_calibr, plus an additional value called "Margin 1." This test compares the present sensor response at the prescribed duty cycle against the reference value of sensor response SR_calibr that was obtained and recorded at the same duty cycle during an earlier event, such as the calibration of method 300, for example. A higher sensor response in the presence of mirror 168 may indicate that the sensor 160 is performing more poorly than it was in the past. One possible explanation is a build-up of dust, ink, or toner on the emitter-sensor pair 160*e*, 160*d*.

If the logical result of block 420 is negative, the performance of sensor 160 is acceptable and the calibration proceeds to select and evaluate the next sensor 160 following process pathway 435 to iteration blocks 434, 412 on FIG. 7. If the logical result of block 420 is positive, the calibration continues to test block 422. If the duty cycle is less than the maximum duty cycle, test block 422 sends the calibration process to block 423 to increase the duty cycle and provide a higher power level to emitter 160*e*. In turn, the detector 160*d* may produce a higher signal that is inverted and converted to a lower signal response as appropriate for the presence of mirror 168. In block 423, the duty cycle is increased in the manner explained previously. At block 426, a calibration point is obtained and includes sensor response that results from the presence of mirror 168 and the adjusted duty cycle. Block 423 iterates with the aid of text blocks 428, 230 until sensor 160 yields a sensor response in block 426 that is less than or equal to the reference value of sensor response SR_calibr for the selected sensor 160 ("yes" at block 428) or the maximum duty cycle is reached ("no" at block 430).

If block 423 terminates due to a negative response at block 430, the calibration proceeds to select and evaluate the next sensor 160 following process pathway 435 to iteration blocks 434, 412 on FIG. 7. In some implementations, the duty cycle may be reset to the stored value read in block 408 following a negative response at block 430. If instead a positive result is achieved at block 428, the calibration moves to block 432. In block 423 the adjusted duty cycle is stored for use during future operations of printer system 100. In at least some instances, the existing reference value of sensor response SR_calibr is retained, unchanged for future use.

In various other implementations, when a maximum duty cycle is achieved at block 430, the calibration proceeds to block 423 to store the maximum duty cycle. In these implementations, either completion result of block 423 causes the adjusted duty cycle to be stored in block 423.

From block 432, method 400 proceeds along process pathway 435 to continuation blocks EE and to block 434 and iteration block 412 on FIG. 7 to select and evaluate the next sensor 160. After the loop initiated by block 412 is completed for the quantity of N sensors 160, calibration method 400 terminates at block 436

The calibration of method 400 includes one calibration point obtained at block 414. In various instances, this calibration includes an additional calibration point or multiple additional calibration points obtained at block at 426, depending on whether or not block 423 is executed and depending on whether or not test block 430 is executed and transfers control back to blocks 424, 426. Thus, in various instances method 400 performs as a one-point calibration, a two-point calibration, or a calibration involving more than two calibration points.

Figure 9:
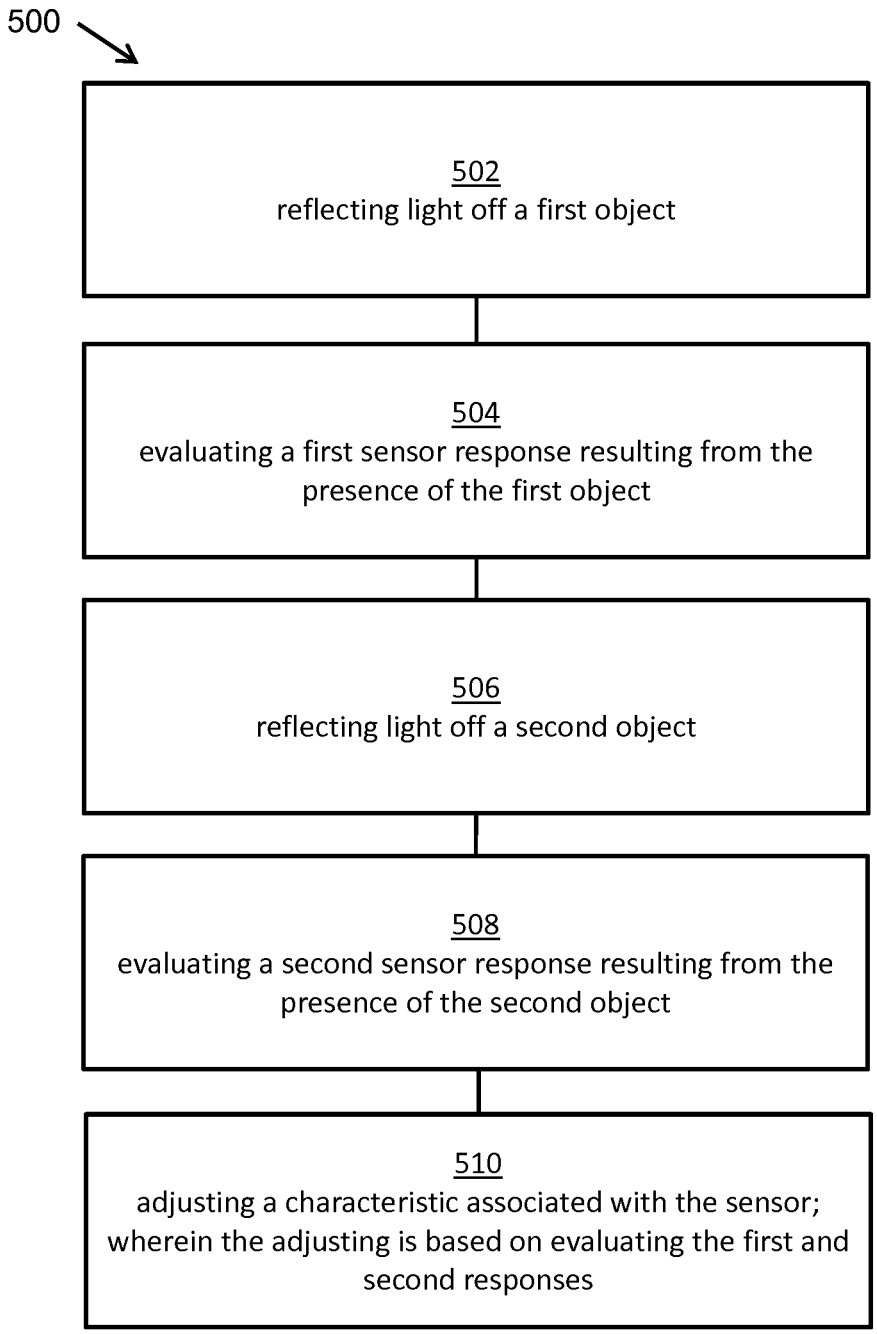
FIG. 9 shows a flow chart of a third calibration method that is appropriate for the printing system of FIG. 1 in accordance with at least one example.

FIG. 9 presents a method 500 involving third calibration for object detection sensors 160. At block 502, method 500 includes reflecting light off a first object. Block 504 includes evaluating a first sensor response resulting from the presence of the first object. Block 506 includes reflecting light off a second object, and block 508 includes evaluating a second sensor response resulting from the presence of the second object. Block 510 of method 500 includes adjusting a characteristic associated with the sensor; wherein the adjusting is based on evaluating the first and second responses.

In some implementations of method 500, the first response is associated with a reference reflective surface. The second response is associated with a print medium; and the reference reflective surface has a higher reflectivity than the print medium. In various implementations of method 500, the process of adjusting the characteristic associated with the sensor comprises adjusting a power level associated with the emitter.

In various instances of method 500 includes various blocks or steps from methods 300, 400.

In addition to printer system 100 and other printer systems, the three calibration methods described herein may also be applicable to various other systems having any of various implementations of the object detection sensor 160. For example, the object detection sensor 160 and any of the calibration methods described herein may be applicable for systems that sensing product presence in a paper mill rolling operation and for systems that detect a plate of raw material adjacent a milling machine, for example.

As indicated in the previous portion of the discussion, multiple variations and modifications are possible for the features, devices, and systems disclosed herein. Some additional details, variations, and modifications are explained in the follow paragraphs.

Although emitter 160*e* and detector 160*d*, as described, exchange an optical signal; in various implementations, an object detection sensor, e.g., a print medium detection sensor, may include an emitter-detector pair configured to exchange any of a variety of signals or energy. The emitter-detector pair may be described as being "coupled" by the signal that is exchanged. The coupling signal may be another form of electromagnetic transmission, such as microwave or radio frequency waves, for example. As another example, the coupling signal may be sound waves (sonar).

In various implementations, the emitter, e.g., emitter 160*e*, may couple to a variable focus lens or to a variable aperture device to modulate the intensity of the energy, e.g., the light, traveling through transmission path 169 to the detector, and some of these implementations may supply a generally constant power to the emitter rather than supplying variable power. In such implementations, the effective focal length of the lens or the aperture diameter is a characteristic associated the sensor and may be adjusted by processor 180.

In various implementations, processor 180 may be implemented as multiple, coupled processors distributed within printer system 100. The operations, responses, or information described in association with processor 180 in this specification may be shared or delegated among the distributed processors.

In various implementations, printer system 100 may, on occasion, couple and incorporate an external processor or an external non-transitory computer-readable storage device to perform a calibration of print medium detection sensor 160 or to aid processor 180 in performing a calibration. Results from the calibration may be stored in processor 180, the external processor, or the external storage device.

Some portions of the sequences shown in the example calibration methods 300, 400, 500 may be modified in various implementations. For example, in various implementations of methods 300, 400, an iteration of a "For-Next" logic loop is completed for an individual sensor 160 prior to performing similar operations for other sensors 160. In some other implementations, various operations of the logic loop may be applied to multiple sensors 160 before moving to another operation in the logic loop. Examples of these logic loops include the loop initiated at block 304 (FIG. 4) and the loop initiated at block 412 (FIG. 7).

As an example of another possible modification to method 300, in some implementations, print medium 107 may be loaded (block 320) so as to be within the transmission paths 169 of multiple of the print media detection sensors 160 prior to obtaining a sensor response i.e., a calibration point, for the first selected sensor (i=1) in block 322. Then, block 322 may be processed for the multiple sensors 160 within the first iteration of the loop that spans block 304 to block 330. In general, the iteration loops within methods 300, 400 are conceptual and may be implemented in any manner or sequence that results in the described evaluation of the various sensors 160. Though the evaluations of the individual sensors 160 has been described in some instances as separate operations, in various implementations, multiple sensors 160 are evaluated concurrently during a calibration. In these and other ways, the sequencing of method blocks or steps for the various methods 300, 400, 500 may be modified in various implementations.

The print medium detection sensors and the calibration methods described herein are applicable in a variety of printer systems having a variety of image forming mechanisms, including for example, jet ink printers with moving print heads, printers with page-wide array print mechanisms, and laser printers. The print medium detection sensor and the calibration methods are applicable in handling systems for cut sheets of print media, handling systems for rolled sheets of print media, and automatic document feeders (ADFs) such as may be used for scanners or photocopiers, including ADFs in multifunction printers. The printer systems or ADFs may include a different number of print medium detection sensors than described in the examples herein, the sensors being positioned at various locations in printer systems or ADFs. The calibration frequency may differ for the various print medium detection sensors.

The above discussion is meant to be illustrative of the principles and various embodiments of the present invention. Numerous other variations and modifications will become apparent to those skilled in the art once the above disclosure is fully appreciated. It is intended that the following claims be interpreted to embrace all such variations and modifications.

What is claimed is:

1. A printer system, comprising:

a handling system to move print media;

a print medium detection sensor to produce a response indicative of an object;

a reference surface mounted facing the sensor; and a processor coupled to the handling system and to the print medium detection sensor to two-point calibration of the sensor;

wherein a first point of the two-point calibration comprises a first response from the sensor based on a print medium, and a second point of the two-point calibration comprises a second response from the sensor based on the reference surface, wherein the processor is to perform the two-point calibration using at least the first response and the second response, and wherein the reference surface is a mirror.

2. The printer system of claim 1 wherein the first response results from the presence of a first object and a second response results from the presence of a second object.

3. The printer system of claim 2 wherein the second object comprises the print medium, and the first object comprises the reference surface.

4. The printer system of claim 2 wherein based on the first and second responses, the processor is selectively to adjust a characteristic associated with the sensor.

5. The printer system of claim 4 wherein the characteristic adjusted by the processor is a magnitude of a sensor response.

6. The printer system of claim 4 wherein the processor is to compare a response from the sensor against a threshold value to detect the presence of the print medium in the handling system;

wherein the characteristic adjusted by the processor s the threshold value.

7. The printer system of claim 4 wherein the sensor comprises an optical emitter and an optical detector; and wherein the characteristic adjusted by the processor is variable power level associated with the emitter.

8. A printer system comprising, a handling system for print media;

a print medium detection sensor;

a reference surface mounted facing the sensor; and a processor coupled to the handling system and to the print medium detection sensor to perform a plurality of different types of calibrations of the sensor, wherein the print medium sensor is an optical sensor comprising an emitter and a detector to exchange a signal via a transmission path;

wherein at least during the first type of calibration the transmission path includes reflection from a first object and, separately, includes reflection from a second object, wherein the first type of calibration is based on a first signal associated with the reflection from the first object and a second signal associated with the reflection from the second object, wherein the first object is a print medium and the second object is the reference surface, and wherein the reference surface is a mirror.

9. The printer system of claim 8 wherein the processor is to perform a first type of calibration and a second type of calibration;

wherein based on the first type of calibration, the processor is selectively to adjust a characteristic associated with the sensor; and wherein based on the second type of calibration, he processor is selectively to adjust the characteristic associated with the sensor.

10. The printer system of claim 9 wherein at least during the second type of calibration, the transmission path includes reflection from the first object; and wherein the object has a reflectivity that differs from the reflectivity of the second object.

11. The printer system of claim 9 herein he sensor comprises an optical emitter and an optical detector; and wherein the characteristic associated with the sensor is a power level associated with th emitter.

12. The printer system of claim 8 wherein at least one type of calibration is a two-point calibration.

13. The printer system of claim 12 wherein a first point of the two-point calibration comprises a first response from the sensor based on interaction with a first object and a second point comprises a second response from the sensor based on interaction with a second object.

14. The printer system of claim 13 wherein the second object comprises a print medium, and the first object comprises a reference surface having higher reflectivity than the print medium.

15. The printer system of claim 13 wherein the processor is to perform a single-point calibration having a third point comprising a third response; wherein the third response is to result from the sensor interacting with the first object.

16. The printer system of claim 8 wherein the print medium sensor is an optical sensor comprising an emitter and a detector to transfer a signal via a transmission path;

wherein a first type of calibration is a two-point calibration;

wherein at least during the first type of calibration, a first object influences the transmission path to produce a first calibration point, and second object influences the transmission path to produce a second calibration point; and wherein at least during a second type of calibration, the first object influences the transmission path to produce a third calibration point.

17. The printer system of claim 8 wherein the processor is to cause a first type of calibration based on receipt of an external command signal; and wherein the processor is to monitor a printer operational parameter and to cause a second type of calibration based on the printer operational parameter.

18. A method for calibrating an object detection sensor, the method comprising:

reflecting light off a first object, the first object being a reference surface mounted on a device;

evaluating a first sensor response resulting from the presence of the first object;

reflecting light off a second object, the second object being a print medium;

evaluating a second sensor response resulting from the presence of the and object; and adjusting a characteristic associated with the sensor; wherein the adjusting is based on evaluating the first and second responses, wherein the reference surface is a mirror.

19. The method of claim 18 wherein the second response is associated with a print medium; and wherein the first response is associated with a reference reflective surface having a higher reflectivity than the print medium.

20. The method of claim 18 wherein adjusting the characteristic compo adjusting a power level associated with the emitter.

* * * * *